US010987259B2

(12) United States Patent
Lazaro Caetano

(10) Patent No.: US 10,987,259 B2
(45) Date of Patent: Apr. 27, 2021

(54) STEP SYSTEM FOR PATIENT STRETCHER

(71) Applicant: Josephine Lazaro Caetano, Brampton (CA)

(72) Inventor: Josephine Lazaro Caetano, Brampton (CA)

( * ) Notice: Subject to any disclaimer, the term of this patent is extended or adjusted under 35 U.S.C. 154(b) by 268 days.

(21) Appl. No.: 16/001,876

(22) Filed: Jun. 6, 2018

(65) Prior Publication Data

US 2019/0374412 A1 Dec. 12, 2019

(51) Int. Cl.
*A61G 1/04* (2006.01)
*A47C 7/50* (2006.01)
*A61G 7/053* (2006.01)

(52) U.S. Cl.
CPC ..... *A61G 1/04* (2013.01); *A47C 7/50* (2013.01); *A61G 7/053* (2013.01)

(58) Field of Classification Search
CPC ..... A61G 1/04; A61G 7/053; A61G 1/0293; A61G 1/02; A61G 1/021; A61G 7/08; A61G 13/104; A47C 7/50
USPC ..... 5/507.1
See application file for complete search history.

(56) References Cited

U.S. PATENT DOCUMENTS 420,143 A * 1/1890 Colbert ..... E06C 7/48 182/206
884,204 A * 4/1908 Piper ..... B60N 2/286 297/250.1
1,273,354 A * 7/1918 Ganzel ..... A47B 11/00 108/139
1,325,423 A * 12/1919 Stuart ..... A47K 3/122 4/578.1
1,345,668 A * 7/1920 Fairchild ..... B61D 23/02 105/447
1,930,882 A * 10/1933 McRae ..... A47B 23/02 108/49
2,059,240 A * 11/1936 Johnston ..... A47D 7/00 5/100
2,127,442 A * 8/1938 Dowdy ..... A61G 7/053 297/47
2,436,961 A * 3/1948 Gabriel ..... B60R 3/02 182/88
2,483,920 A * 10/1949 McLean ..... A47B 23/02 108/49
2,524,971 A * 10/1950 Gray ..... E06C 1/397 182/64.1
2,532,705 A * 12/1950 Freund ..... A61G 5/128 5/624
2,533,050 A * 12/1950 Runyen ..... B60R 3/02 182/88
2,644,961 A * 7/1953 Hillenbrand ..... A61G 7/053 5/507.1

(Continued)

*Primary Examiner* — Nicholas F Polito
*Assistant Examiner* — Luke Hall
(74) *Attorney, Agent, or Firm* — Argus Intellectual Enterprise; Jordan Sworen; Daniel Enea

(57) ABSTRACT

A step system including a patient support member having a deployable step assembly including a deployable step. The deployable step assembly is fixed and integral to the patient support member and is configured to deploy as needed to provide a sturdy platform for at least one medical professional in a standing position while performing medical procedures on a patient. The deployable step assembly may include deployable steps on both a right-side and a left-side of the patient support member.

16 Claims, 5 Drawing Sheets

(56) References Cited

U.S. PATENT DOCUMENTS 2,659,902 A * 11/1953 Fitzgerald ..... A61G 7/053 5/507.1
2,682,671 A * 7/1954 Faure ..... A61G 7/053 5/507.1
2,798,732 A * 7/1957 Craig ..... A01G 20/30 280/641
2,941,215 A * 6/1960 Johnson ..... A47C 16/02 5/507.1
3,033,309 A * 5/1962 Fugere ..... E06C 1/381 182/90
3,252,169 A * 5/1966 Propst ..... A61G 1/0212 5/89.1
3,627,350 A * 12/1971 Cross ..... B60R 3/02 280/166
3,629,881 A * 12/1971 Hinshaw ..... A47C 20/021 5/507.1
3,643,605 A * 2/1972 Miller, Jr. ..... A47B 27/00 108/6
3,756,622 A * 9/1973 Pyle ..... B60R 3/02 280/166
3,817,554 A * 6/1974 Cuffe ..... B60R 3/02 280/166
3,834,726 A * 9/1974 Hobza ..... B62B 5/0026 280/87.041
4,106,790 A * 8/1978 Weiler ..... B60R 3/02 182/88
4,190,280 A * 2/1980 Donohoe ..... A61G 1/04 280/32.7
4,206,525 A * 6/1980 Williams ..... A47C 21/00 5/430
4,222,136 A * 9/1980 Valentino ..... A47C 21/00 182/92
4,524,475 A * 6/1985 Valentino ..... A47C 21/00 182/91
4,564,965 A * 1/1986 Goodwin ..... A61G 7/05746 5/406
4,763,368 A * 8/1988 Lucero ..... A47D 7/00 5/100
4,982,464 A * 1/1991 Lucero ..... A47D 7/00 250/455.11
5,005,667 A * 4/1991 Anderson ..... A47B 77/10 182/15
5,380,034 A * 1/1995 Wilson ..... A61G 5/006 280/30
5,505,476 A * 4/1996 Maccabee ..... B60R 3/02 280/163
5,664,266 A * 9/1997 Williams ..... A61G 5/1059 297/6
5,738,362 A * 4/1998 Ludwick ..... B60R 3/02 280/166
5,894,616 A * 4/1999 Graham ..... A61G 7/052 5/424
6,047,422 A * 4/2000 Yousif ..... A47C 19/04 5/184
6,213,486 B1 * 4/2001 Kunz ..... B60R 3/02 280/163
6,598,844 B2 * 7/2003 Barber ..... A47B 21/0314 248/284.1
6,659,484 B2 * 12/2003 Knodle ..... B60R 3/02 248/131
6,685,204 B1 * 2/2004 Hehr ..... B60R 3/02 280/164.1
6,766,547 B1 * 7/2004 Lagassey ..... A61G 1/0567 5/507.1
6,880,843 B1 * 4/2005 Greer, Jr. ..... B60R 3/02 280/166
6,935,647 B2 * 8/2005 Knodle ..... B60R 3/02 280/166
7,076,817 B1 * 7/2006 Garver ..... A61G 7/012 425/430
7,204,501 B2 * 4/2007 Bang ..... B60R 3/02 248/131
7,971,884 B2 * 7/2011 Lundh ..... B62B 9/28 280/32.7
7,987,538 B1 * 8/2011 Kimball ..... A61G 7/0524 5/662
8,016,301 B2 * 9/2011 Figel ..... B60B 33/0092 280/47.38
8,239,986 B2 * 8/2012 Heimbrock ..... A61G 7/0521 5/430
8,714,582 B2 * 5/2014 Hei ..... B62B 9/28 280/656
8,943,624 B1 * 2/2015 Youngstrom ..... A47C 19/22 5/131
9,828,014 B1 * 11/2017 Gillespie ..... E06C 5/00
10,022,283 B2 * 7/2018 Lawless ..... A61G 1/02
10,618,472 B2 * 4/2020 Du ..... B60R 3/002
2002/0195792 A1 * 12/2002 Hendrix ..... B60R 3/002 280/164.1
2011/0219541 A1 * 9/2011 Jacobs ..... A61G 7/0509 5/430

* cited by examiner

STEP SYSTEM FOR PATIENT STRETCHER

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of medical devices and more specifically relates to patient transport devices.

2. Description of Related Art

Patient stretchers, gurneys and supports are well known in the art for mobile transport of a medical patient. A bedded horizontal platform may include wheels, swivel and rotatable casters, adjustable height and tilt mechanisms, foot pedals for controlling movement of the patient support surface, push handles for mobility, lifts to elevate and lower the patient support surface, and shrouds for accommodating instruments. There is a need to safely administer emergency and often life-saving medical care while transporting a patient. For example, in some instances, such as in the case of a patient in cardiac arrest, cardiopulmonary resuscitation (CPR) must be maintained continuously until a heartbeat is restored. Currently, when performing CPR, it is not possible for medical professionals perform CPR while being mobile. It may be difficult to access the patient of a patient stretcher or bed. A suitable solution is desired.

U.S. Pat. No. 6,766,547 to Paul J. Lagassey relates to a wheeled patient stretcher with attendant platforms. The described wheeled patient stretcher with attendant platforms includes a wheeled patient support assembly that allows a patient and at least one medical attendant to be moved while the medical attendant(s) administer medical treatment to the patient comprising a patient support surface, rolling mechanisms or other means for moving the assembly over the floor, at least one attendant support platform(s) built into or connected with the assembly and constructed to support the weight of one or more attendant(s) and being positioned so the attendant(s) can safely stand on the platform section(s) and treat the patient while the assembly is being moved, and including safety railings to prevent the attendant(s) from falling off the assembly. Further, the assembly is designed and constructed to be stable to prevent it from tipping, leaning or becoming unstable while in use. The object of the invention is to allow a patient to be moved simultaneously while emergency medical care is administered.

BRIEF SUMMARY OF THE INVENTION

In view of the foregoing disadvantages inherent in the known medical device art, the present disclosure provides a novel step system for a patient stretcher or hospital bed. The general purpose of the present disclosure, which will be described subsequently in greater detail, is to provide a sturdy platform for supporting a medical professional while performing CPR or other medical procedures during transport.

A step system is disclosed herein. The step system includes a patient support member such as a patient stretcher or hospital bed has a deployable step assembly including a deployable step. The deployable step assembly is fixed and integral to the patient support member and configured to deploy as needed to provide a sturdy platform for a medical professional(s) in a standing position while performing medical procedures on a patient. The deployable step assembly is configured on at least one side portion of the patient support member. The deployable step assembly may be on both a right-side and a left-side of the patient support member and is configured to provide access to the patient from the right-side and the left-side by two medical professionals during procedures such as CPR which may require two medical professionals. The device is configured to be easily maneuvered through hospital halls during patient transfer. A method of using the device is also disclosed herein.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a step system for a patient stretcher, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a medical device and more particularly to a step system for a patient stretcher as used to improve access to a patient on a stretcher or bed during transport.

Generally, the step system is an easily deployable step system for use on patient stretchers to help attendants perform CPR while the patient is being transferred to a hospital or trauma room. The step system includes steps attached to the stretcher or hospital bed which may be deployed and used to perform CPR or other medical interventions during an emergency situation. The steps may be located in key position(s) to perform various medical procedure(s). The steps are configured to support a weight of a medical professional when deployed from underneath the stretcher or bed. The step system may be positioned on one or both sides of a hospital bed or stretcher providing a platform and allowing two medical professionals to perform CPR. The platform may extend an entire length of the patient stretcher or half of the length of the patient stretcher in alternate embodiments.

Figure 1:
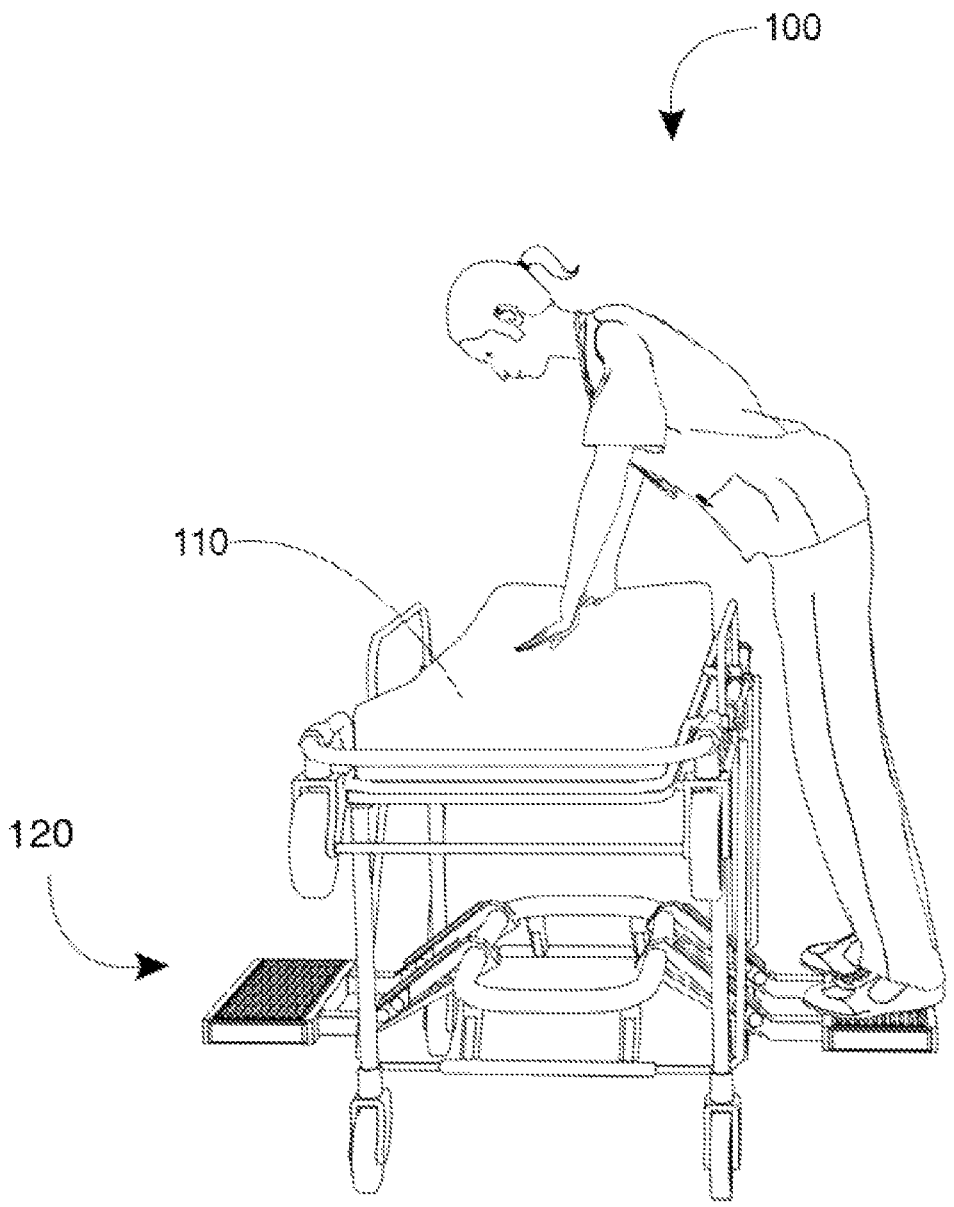
FIG. 1 is a perspective view of the step system during an 'in-use' condition, according to an embodiment of the disclosure.

Referring now more specifically to the drawings by numerals of reference, there is shown in FIGS. 1-5, various views of a step system 100. FIG. 1 shows a step system 100 during an 'in-use' condition 150, according to an embodiment of the present disclosure. As illustrated, the step system 100 may include a patient support member 110 having a deployable step assembly 120 including a deployable step 130. The deployable step assembly 120 is fixed and integral to the patient support member 110 and is configured to deploy as needed to provide a sturdy platform for a medical professional in a standing position while performing medical procedures on a patient.

Figure 2:
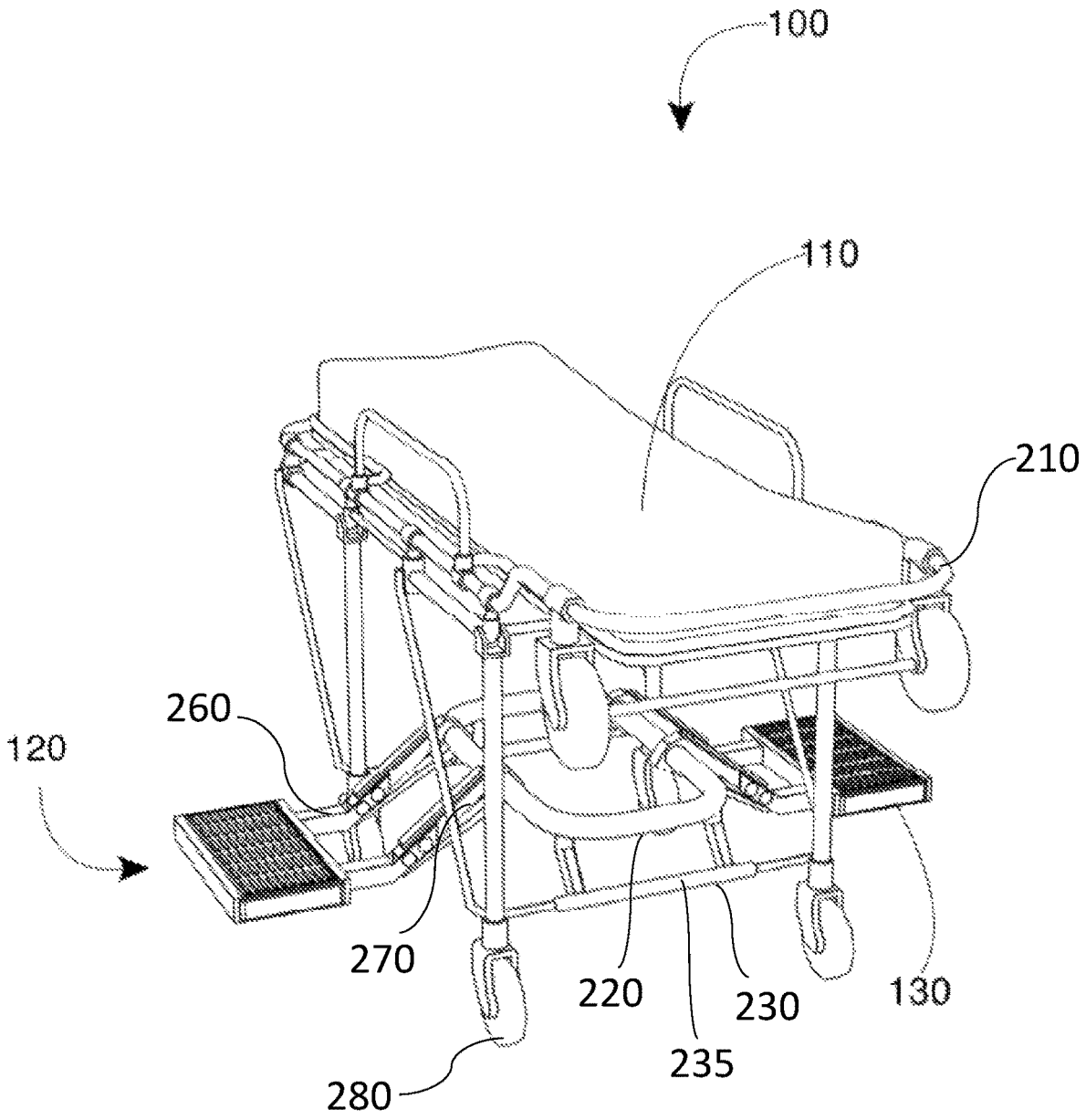
FIG. 2 is a perspective view of the step system of FIG. 1, according to an embodiment of the present disclosure.

FIG. 2 shows a perspective view of the step system 100 of FIG. 1, according to an embodiment of the present disclosure. As above, the step system 100 may include the patient support member 110 having the deployable step assembly 120 including the deployable step 130 in functional combination. The patient support member 110 may include a patient stretcher or hospital bed. The deployable step assembly 120 is configured on at least one side portion of the patient support member 110. The deployable step assembly 120 may be on both a right-side and a left-side of the patient support member 110 and is configured to provide access to the patient from the right-side and the left-side by one or two medical professionals. The deployable step assembly 120 on the right-side and the left-side of the patient support member 110 are configured to be used simultaneously and each support one medical professional during procedures which may require two medical professionals.

Figure 3:
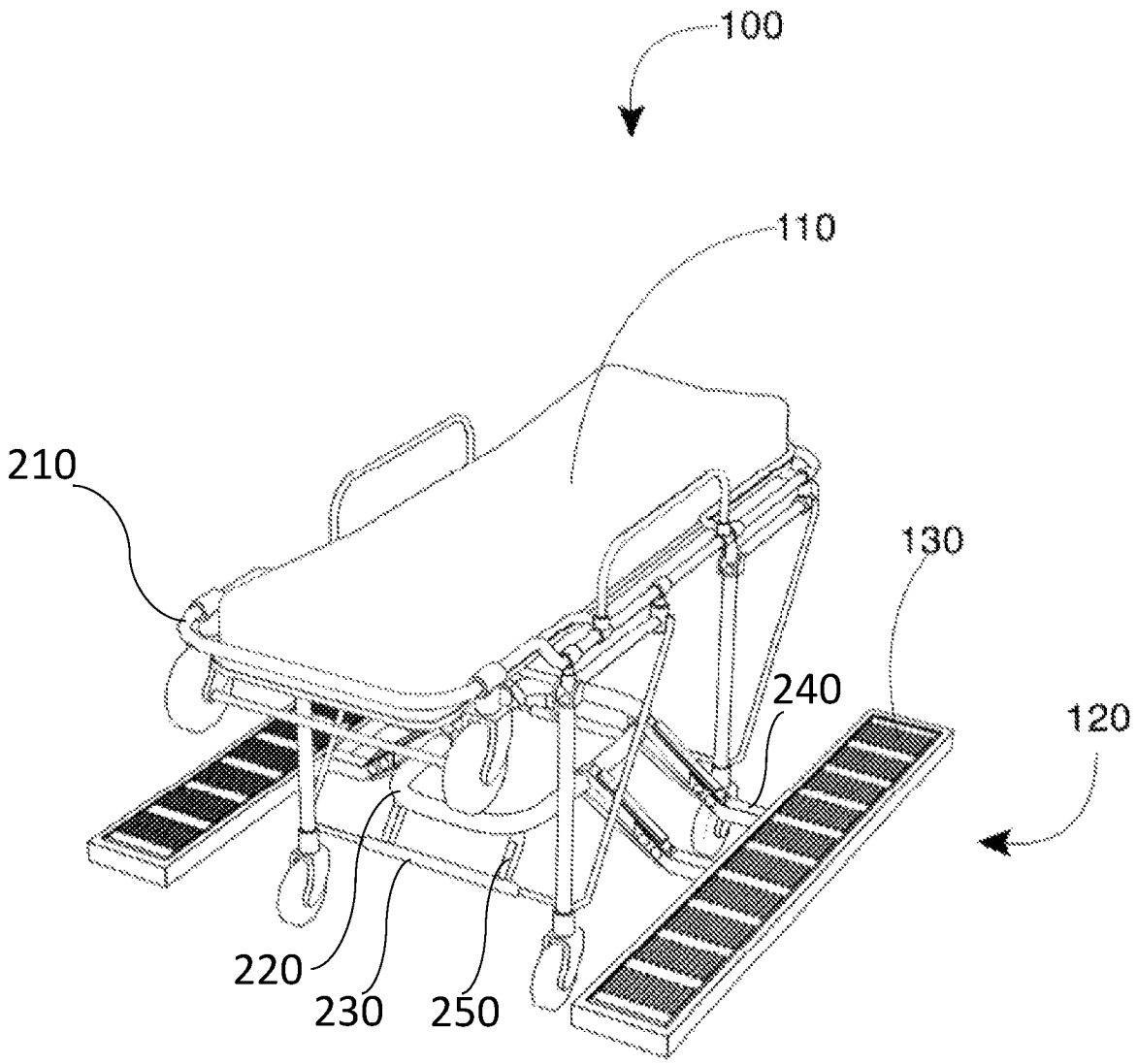
FIG. 3 is a perspective view of the step system of FIG. 1, according to an embodiment of the present disclosure.

Referring now to FIG. 3 showing a perspective view of the step system 100 of FIG. 1, according to an embodiment of the present disclosure. As above, the step system 100 may include the patient support member 110 with a deployable step assembly 120 having the deployable step 130. The deployable step assembly 120 may be non-removeable from the patient support member 110. In other embodiments, the deployable step assembly 120 is configured to be retro-fitted to the patient support member 110. The retro-fitted deployable step assembly 120 may be attached to the patient stretcher or hospital bed using various fastening means. The deployable step 130 includes a single deployable step 130 which is free standing and does not contact a ground surface when deployed. The deployable step assembly 120 is configured to retract during non-use. The deployable step assembly 120 is configured underneath the patient support member 110 and extends along a length of the patient support member 110.

In the illustrated embodiment, the patient support member comprises an upper frame 210 for supporting the patient thereon and a lower frame 230, wherein the lower frame 230 comprises a pair of cross members 235 each extending between a pair of wheels 280. The deployable step assembly 120 is secured to the lower frame 230, wherein the deployable step assembly 120 is connected to an interior support frame 220 via an arm 240 affixed to the interior support frame 220 The interior support 220 frame comprises a circular cross-section and forms a closed tubular loop that extends along each edge of the upper frame 210. The interior support frame 220 is oriented on a horizontal plane relative to the ground. A perimeter of the interior support frame 220 is entirely positioned within the boundary of the pair of opposing cross members 235. In the illustrated embodiment, the interior support frame 220 is centrally positioned beneath the patient support member and raised entirely above the lower frame 230. The interior support frame 220 is supported in a raised position via a plurality of angled rods 250 extending from the lower frame. The deployable step 130 is movable between a deployed configuration (see FIG. 3) and a stored configuration (see FIG. 4), wherein the deployed configuration, the deployable step 130 and a first section 260 of the arm are horizontal and a second section 270 of the arm is positioned at a decline away from the interior support frame 220 such that the deployable step 130 is lower than the interior support frame 220. In the stored configuration, the deployable step 130 is substantially vertical and parallel to the first and second section of the arm 260, 270, wherein transitioning to the stored wherein transitioning to the stored configuration, the second section moves about the interior support frame 220.

Figure 4:
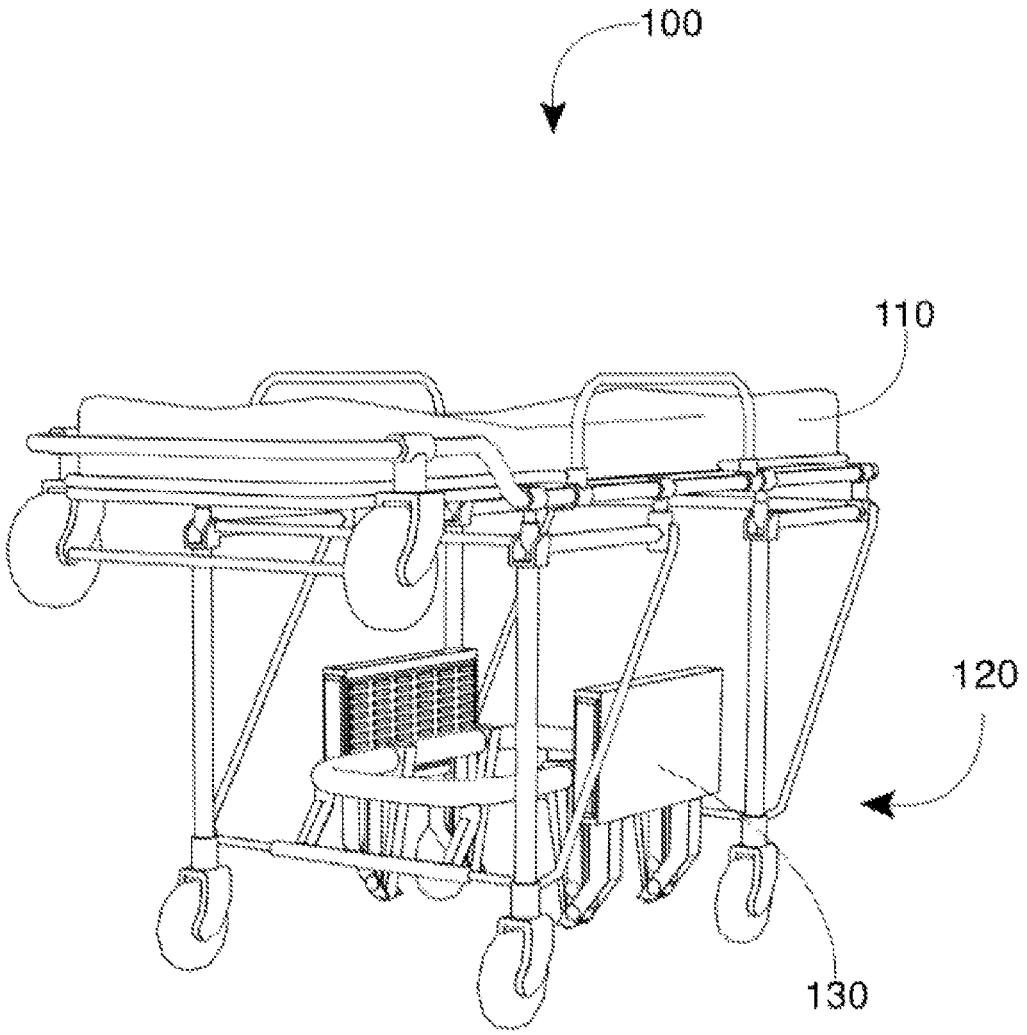
FIG. 4 is a perspective view of the step system of FIG. 1, according to an embodiment of the present disclosure.

FIG. 4 shows a perspective view of the step system 100 of FIG. 1, according to an embodiment of the present disclosure. As above, the step system 100 may include the patient support member 110 with a deployable step assembly 120 having the deployable step 130. The deployable step assembly 120 when deployed (hereby enabling method of using) is configured to support a weight of the medical professional without tipping the patient support member 110. The deployable step assembly 120 comprises aluminum or other suitable sturdy material for supporting the weight of the medical professional and may be returned after use. The deployable step assembly 120 includes the sturdy platform and has a width configured to support and accommodate feet of varying sizes. A balancing means may also be included so the center of gravity is located as low as possible and such that the patient support member 110 does not tip during use.

Figure 5:
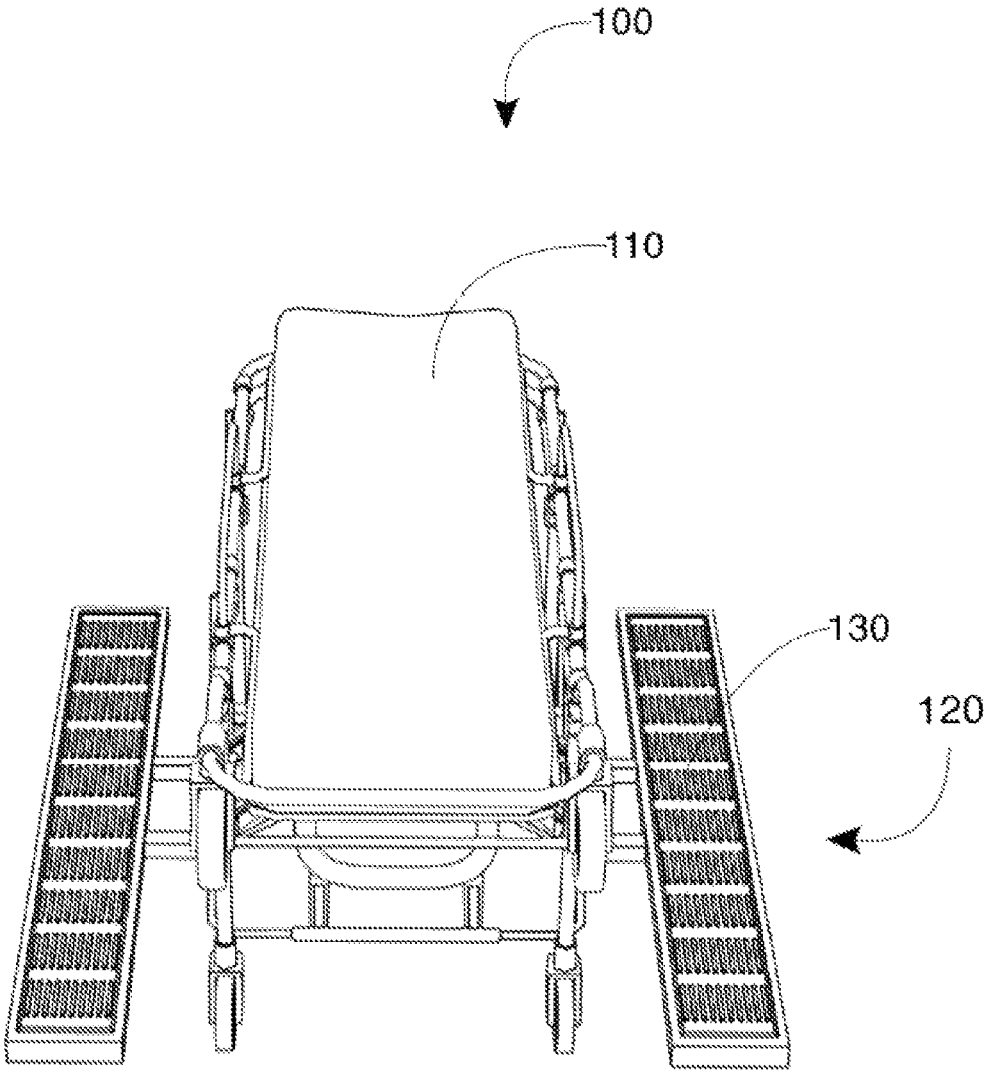
FIG. 5 is a perspective view of the step system of FIG. 1, according to an embodiment of the present disclosure.

Referring now to FIG. 5 showing a perspective view of the step system 100 of FIG. 1, according to an embodiment of the present disclosure. As above, the step system 100 is configured to provide a sturdy platform for medical professionals while performing the medical procedures on a patient such as CPR. The deployable step assembly 120 is configured to be used while the patient support member 110 is moving during patient transport. The patient support member 110 and the deployable step assembly 120 when deployed has a width less than a hallway allowing the patient support member 110 to be maneuvered through hallways during patient transport.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A step system comprising:

a patient support member having an upper frame for supporting a patient thereon and a lower frame, wherein the lower frame comprises a pair of cross members each extending between a pair of wheels;

a deployable step assembly secured to the lower frame, wherein the deployable step assembly comprises an interior support frame, a deployable step connected to the interior support frame via an arm affixed to the interior support frame;

the interior support frame forming a closed tubular loop that extends along each edge of the upper frame, wherein the interior support frame is oriented on a horizontal plane relative to a ground surface;

wherein a perimeter of the interior support frame is entirely positioned within the boundary of the pair of cross members;

wherein the arm comprises a first section connected to a second section;

wherein the interior support frame is centrally positioned beneath the patient support member and raised above the lower frame;

wherein the deployable step assembly is movable between a deployed configuration and a stored configuration;

wherein the deployed configuration, the deployable step and the first section are horizontal and the second section is positioned at a decline away from the interior support frame such that the deployable step is lower than the interior support frame;

wherein the stored configuration, the deployable step is substantially vertical and parallel to the first and second section of the arm;

wherein transitioning to the stored configured, the second section moves about the interior support frame.

2. The step system of claim 1, wherein said patient support member is selected from the group consisting of a patient stretcher and hospital bed.

3. The step system of claim 1, wherein said deployable step assembly is configured on at least one side portion of said patient support member.

4. The step system of claim 3, wherein said deployable step assembly is configured on both a right-side and a left-side of said patient support member and configured to provide access to said patient from said right-side and said left-side.

5. The step system of claim 1, wherein said deployable step assembly is non-removeable from said patient support member.

6. The step system of claim 1, wherein said deployable step assembly is configured to be retro-fitted to said patient support member.

7. The step system of claim 1, wherein said deployable step when deployed is configured to support a weight of a medical professional without tipping said patient support member.

8. The step system of claim 7, wherein said deployable step assembly comprises aluminum for supporting said weight of said medical professional.

9. The step system of claim 1, wherein said deployable step extends along a length of said patient support member.

10. The step system of claim 1, wherein said deployable step comprises a width configured to support feet.

11. The step system of claim 1, wherein said deployable step assembly is configured to be used while said patient support member is moving during patient transport.

12. The step system of claim 1, wherein the interior support frame comprises a circular cross section.

13. The step system of claim 1, wherein the interior support frame is supported in a raised position via a plurality of angled rods extending from the lower frame.

14. The step system of claim 1, wherein the deployable step assembly comprises a pair of deployable steps secured on opposing sides of the interior support frame.

15. The step system of claim 1, wherein the deployable step is suspended above a ground surface when in the deployed and stored configurations.

16. The step system of claim 1, wherein the interior support frame is raised entirely above the lower frame.

* * * * *